United States Patent [19]

Wasserman et al.

[11] Patent Number: 4,925,518

[45] Date of Patent: May 15, 1990

[54] COMPLIANT LENS BLOCKS AND METHOD OF USING THEM

[76] Inventors: Nelson M. Wasserman, 32 Pickwick Rd., West Newton, Mass. 02165; Irving Erlichman, 22 Wayland Hills Rd., Wayland, Mass. 01778

[21] Appl. No.: 226,379

[22] Filed: Jul. 29, 1988

[51] Int. Cl.[5] ..... B32B 31/20

[52] U.S. Cl. ..... 156/295; 51/216 LP; 428/40; 428/136

[58] Field of Search ..... 51/216 LP; 156/295; 428/40, 134, 136

[56] References Cited

U.S. PATENT DOCUMENTS

| | | | |
|---|---|---|---|
| Re. 31,897 | 5/1985 | Johnson | 51/284 R |
| 3,962,833 | 6/1976 | Johnson | 51/216 LP X |
| 4,118,898 | 10/1978 | Godot | 51/216 LP |
| 4,158,273 | 6/1979 | Olsen et al. | 51/284 R |
| 4,221,083 | 9/1980 | Carroll | 51/284 R |
| 4,242,162 | 12/1980 | Ronning et al. | 156/212 |
| 4,287,013 | 9/1981 | Ronning | 156/242 |
| 4,358,913 | 11/1982 | Sorrells | 51/216 LP |
| 4,479,332 | 10/1984 | Stern et al. | 51/277 |
| 4,502,909 | 3/1975 | Tomesko | 156/356 |
| 4,530,139 | 7/1985 | Miller | 51/216 LP X |
| 4,677,729 | 7/1987 | Morland et al. | 29/426.5 |

*Primary Examiner*—Robert A. Dawson

*Attorney, Agent, or Firm*—Thomas J. Engellenner

[57] ABSTRACT

A lens block having a compliant structure adapted to receive and hold a lens blank or similar optical element is disclosed. The flexibility of the block, itself, ensures that the optical element can be held without breakage during the various shaping operations, such as grinding, edging, and polishing, encountered in preparing a lens for mounting in an eyeglass frame or similar receptacle. The block can be a disposable element coated with, or otherwise carrying, an adhesive material for simple application to lens blank. In one embodiment, a compliant lens block is formed having a dish-shaped receiving surface on one side for receiving the lens blank and an appropriate key structure on the other side for mounting into the chuck of a grinding lathe, edger or other lens shaping machine. The lens-receiving surface is divided into two or more flexible lands, separated at least partially by slots, so that the shape of the dish is compliant and, therefore, can conform to the lens blank, regardless of curvature or surface discontinuities.

10 Claims, 4 Drawing Sheets

COMPLIANT LENS BLOCKS AND METHOD OF USING THEM

BACKGROUND OF THE INVENTION

The technical field of this invention is the preparation of optical lenses and, in particular, the invention relates to methods and devices for preparing lens blanks to fit eyeglasses and other lens-holding receptacles.

The process of preparing optical lenses, particularly lenses for glasses and the like, normally begins with a semi-finished lens blank made from glass or plastic. Such blanks typically have a finished, polished front surface and an unfinished back surface. The necessary corrective prescription is obtained by grinding away material from the back surface, followed by polishing and edge-shaping to fit the frame or other receptacle.

During these operations, the lens blank must be accurately aligned and securely held in place. For this reason, the finished surface of the lens blank is conventionally mounted onto a "lens block" which remains joined to the lens throughout the processing steps. Blocking machines are employed to align the optical center of the lens blank and, optionally, an optical axis of the blank with a reference point or configuration on the lens block.

Conventional blocking machines employ a variety of adhesive materials (e.g., glues, pitch or low temperature fusible metal alloys) to secure the lens blank to the block. The blocks are typically hard metal or plastic and, consequently, are not well adapted to the variety of the shapes which may be presented by finished (typically convex) surface of the lens blank. Many blocking systems resort to multiple blocks having varying degrees of concavity in order to accommodate the variable curvature of lens blanks necessary to fill differing eyeglass prescriptions.

However, even when the block and blank are closely matched in terms of mating surface curvatures, complex prescriptions, such as bifocals and trifocals, require blanks that inherently have discontinuous surfaces. In these instances, conventional blocking techniques are often less than satisfactory. When the block does not securely hold the lens blank curing processing, breakage will often occur during the high speed grinding or shaving operations.

Conventional blocking techniques are also labor-intensive. In addition to the need for different blocks (having varying degrees of concavity), plastic and glass lenses can require different types of adhesives, and the surfaces must be washed to remove the adhesive not only from the finished lens but also from the block prior to its reuse in the next processing operation.

An alternative approach to blocking lenses is disclosed in U.S. Reissue Patent No. 31,897 by Johnson and involves the use of a double-sided, adhesive blocking pad which is disposed between the lens and the block. The intermediate pad serves to provide a flexible interface between the lens blank and the rigid block, which is said to permit firm bonding even when the curvatures of the blank and block do not match.

However, even when an intermediate blocking pad is used, the blocking process is still time-consuming since the alignment of the optical center and axis must be performed twice. First, the pad must be aligned with the lens blank and affixed in place. Then the lens blank and pad must together be aligned with and affixed to, the block itself. Any inaccuracy in this multiple step alignment process can result in a lens having incorrect optical refractive properties.

There exists a need for better lens blank blocking methods and devices which can quickly and accurately prepare a lens blank for grinding, edging, polishing or other shaping operations. Blocks which can be securely mounted to lens blanks, regardless of their curvature and without the need for intermediate pads, would satisfy a long felt need in the industry.

SUMMARY OF THE INVENTION

A lens block having a compliant structure adapted to receive and hold a lens blank or similar optical element is disclosed. The flexibility of the block itself ensures that the optical element can be held without breakage during the various shaping operations, such as grinding, edging, and polishing, encountered in preparing a lens for mounting in an eyeglass frame or similar receptacle. In one preferred embodiment, the block is a disposable element coated with, or otherwise carrYing, an adhesive material for simple application to lens blank.

In one illustrated embodiment, a compliant lens block is formed having a dish-shaped receiving surface on one side for receiving the lens blank and an appropriate key structure on the other side for mounting into the chuck of a grinding lathe, edger or other lens shaping machine. The lens-receiving surface is divided into two or more flexible lands, separated at least partially by slots, so that the shape of the dish is compliant and, therefore, can conform to the lens blank, regardless of the curvature or surface discontinuities (e.g., bifocal and trifocal lens structures) of the blank.

In the illustrated embodiments, an adhesive is also preferably pre-applied to the block, for example, by coating, impregnation or sheet deposition techniques to further simplify the blocking operation. The adhesive can be a pressure-sensitive adhesive compatible with conventional blocking machines, and the block can further include a protective cover sheet disposed over to the adhesive surface such that the block can be employed by the technician simply by removing the protective sheet and affixing the lens blank to the block.

The block also includes a key structure, disposed on the opposite side of the block from the lens-receiving surface, for mounting the adhesively-joined lens blank to a shaping machine. The key structure can follow any one of a number conventional designs so as to mate either directly or via an adaptor to the chuck assembly on a commercially-available shaping machine.

The block can further include alignment means for aligning the block with the center point of the lens blank and, optionally, a cylindrical axis of the blank as well. In one embodiment, a central hole is provided in the block for visually aligning the center of the block with the center point of the lens blank, and a set of markers on two diametrically opposed slots are provided for visual or photometric alignment of the block with the cylindrical axis of the optical element.

The blocks of the present invention provide several advantages over the prior art. The compliant design permits the use of a single block shape to fit all lenses. The design also eliminated the need for intermediate pads and avoids the alignment difficulties associated with double-sided, adhesive pads. Additionally, the blocks provide sufficient flexibility to prevent lens breakage while retaining the stiff, torsional rigidity necessary to block the optical element during shaping operations.

Moreover, the blocks of the present invention can be mass produced at high speed by plastic moulding or metal stamping techniques, followed by adhesive application in an automatic mode, and the finished blocks are particularly suitable for mechanized handling to support automated, as well as manual blocking operations.

The invention will next be described in connection with certain illustrated embodiments; however, it should be clear that various additions, subtractions and modifications can be made without departing from the spirit or scope of the invention. For example, although the invention is shown in connection with an embodiment having eight flexible lands which define the lens-receiving surface, it should be clear that a greater or smaller number of such spring elements can be employed in the same manner.

Similarly, the individual flexible lands can be separated by full slots as shown, or by partial slots, or by perforations and yet still achieve the compliant effect. The block can also be equipped with a tab or similar lifting element which is not adherent to the surface of the lens blank in order to provide a readily available lever or grip for removing the block from the finished optical element. Adaptors can be employed to convert the illustrated key structure to other designs employed by the chuck assemblies of other commercial manufacturers to shaping equipment and other materials for the block, itself, and/or its adhesive surface will be apparent to those skilled in the art.

The blocks of the present invention can further include pneumatic or hydraulic means for lens removal following the shaping operations. Non-toxic inert gases and liquids, such as air, nitrogen, carbon dioxide, helium, water, and mineral oils can be pumped into a central cavity of the block thereby applying a fluid pressure to assist in separating the block and the finished lens.

DETAILED DESCRIPTION

Figure 1:
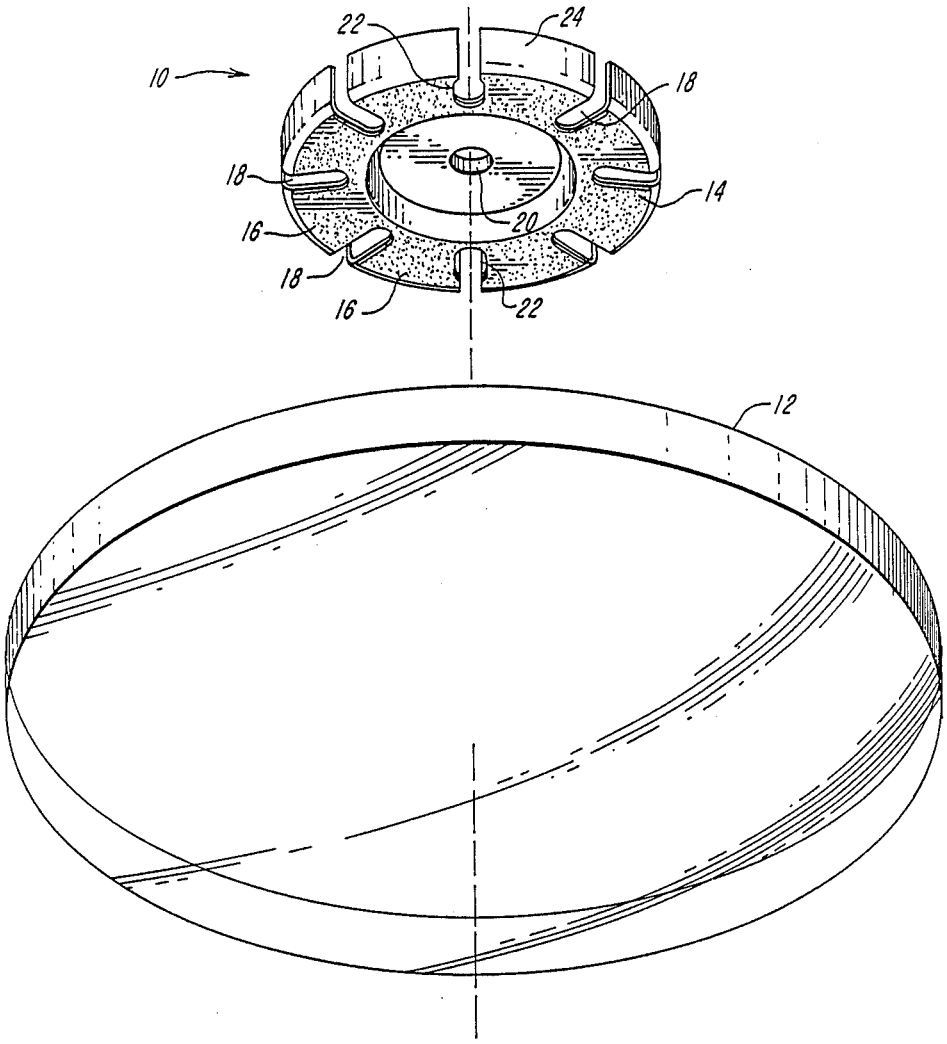
FIG. 1 is a perspective view of a compliant lens block in accordance with the invention.
Figure 2:
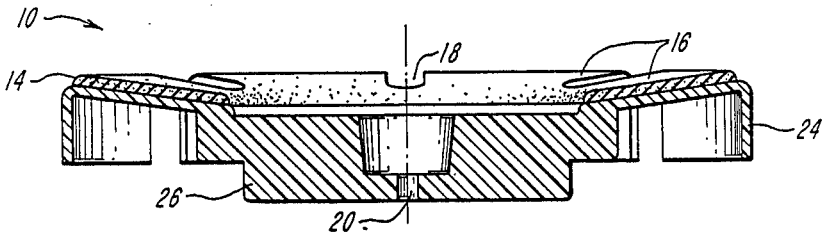
FIG. 2 is a cross-sectional view of the lens block of FIG. 1.
Figure 3:
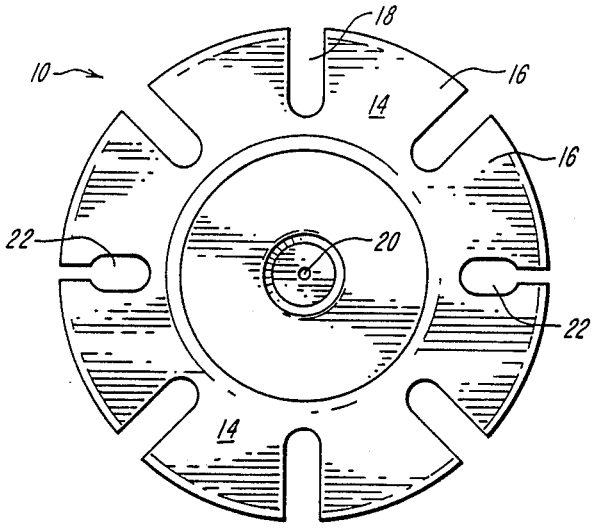
FIG. 3 is front view of the lens block of FIG. 1 (showing the lens-receiving surface of the block)
Figure 4:
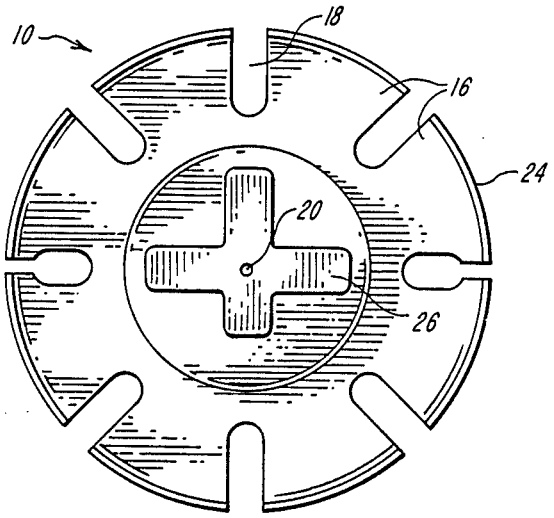
FIG. 4 is a rear view of the lens block of FIG. 1 (showing the chuck mounting key structure)

In FIG. 1, a compliant block 10 is shown disposed above a lens blank 12. As shown in FIG. 1 and further illustrated in FIGS. 2–4, block 10 includes an adhesive coating or surface 14 and a plurality of flexible lands 16, separated from each other by a slot 18. The block 10 further includes a central alignment hole 20 and peripheral axis alignment markers 22. The block 10 can also include flanges 24 to provide additional structural and torsional rigidity With reference to FIG. 4, the raised key structure 26 is shown for mounting the block 10 to the chuck assembly (not shown) of a shaping machine.

The base structure of the block 10 can be made as a draw stamping from a metal, such as steel or from a molded plastic such as high impact polyethylene, polypropylene or the like. The adhesive coating 14 can be deposited during manufacturing using, for example, a polymeric carrier having an acrylic, latex or rubber-based adhesive dispersed therein. Following bonding to the base structure of the block 10, a protective cover sheet (not shown), such as silicone-coated paper, can be disposed over the adhesive surface 14 until the block 10 is ready for use.

The lens block 10 is employed as shown schematically in FIG. 1. The protective paper cover (if any) is removed, and the block 10 is aligned with the lens blank 12. The alignment means of the present invention are particularly well-suited for visual or photometric alignment with an illumination means which transmits light through the center hole 20 and axial markers 22, such alignment of the light sources with pre-defined marks on the lens blank permits simple orientation of the blank with respect to the block. Upon alignment, the two elements are pressed together, bending the flexible lands 16 of the block 10 to conform the surface of the blank 12 and securing the block 10 and blank 12 to each other by action of the adhesive coating 14. Conventionally, the blocking operations are performed with the assistance of blocking machines, such as the Briot Blocker, manufactured by Universal Photonics, Inc. (Hicksville, NY), or similar systems manufactured by others.

Figure 5:
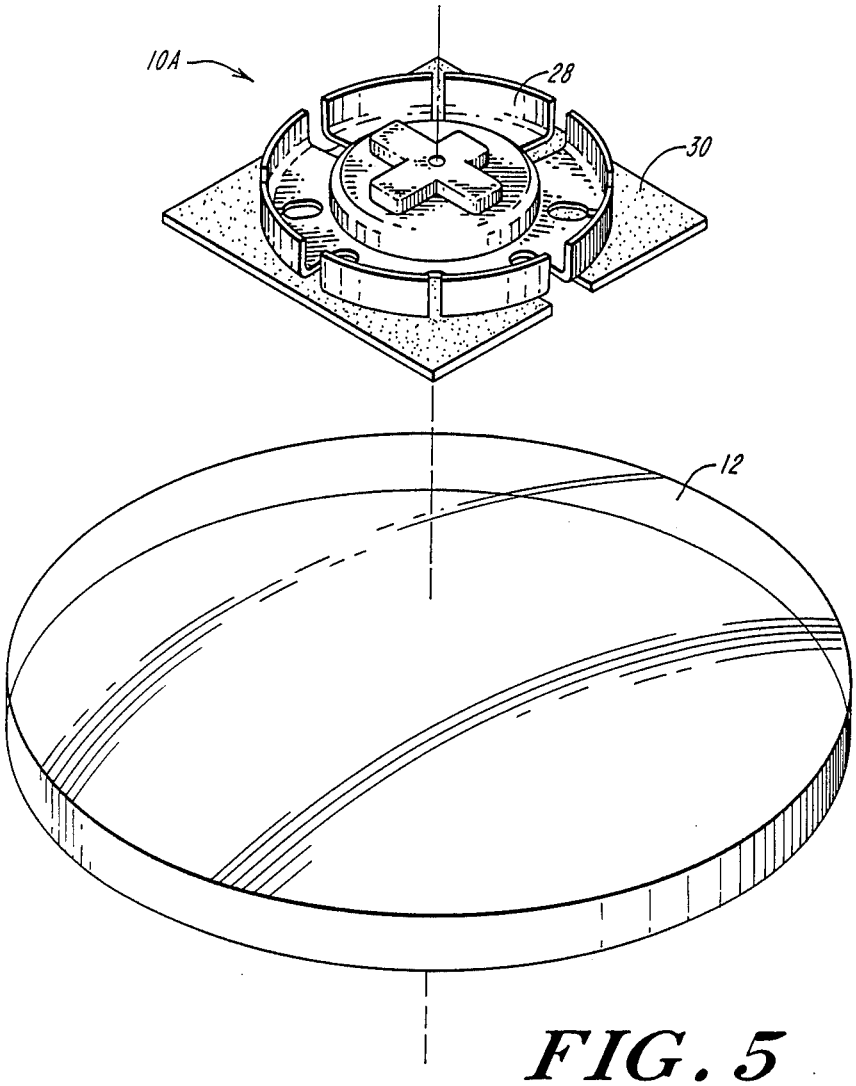
FIG. 5 is a perspective view of another embodiment of a lens block according to the invention.
Figure 6:
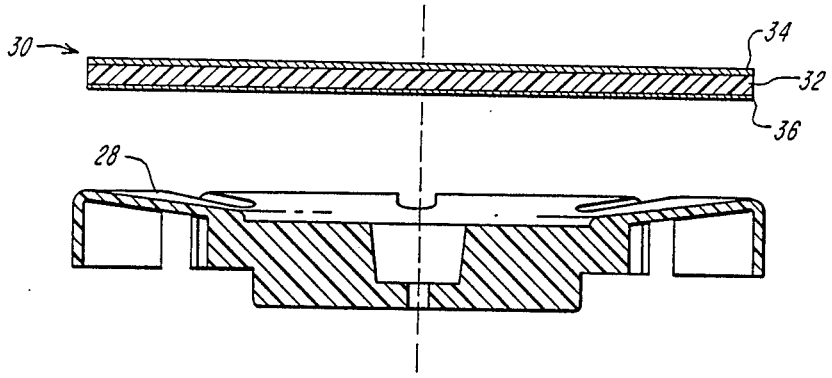
FIG. 6 is cross-sectional view of the lens block of FIG. 5 (illustrating the fabrication of the block from two parts); and FI6. 7 is a front view of the lens block of FIG. 5 (showing the lens-receiving surface of the block).
Figure 7:
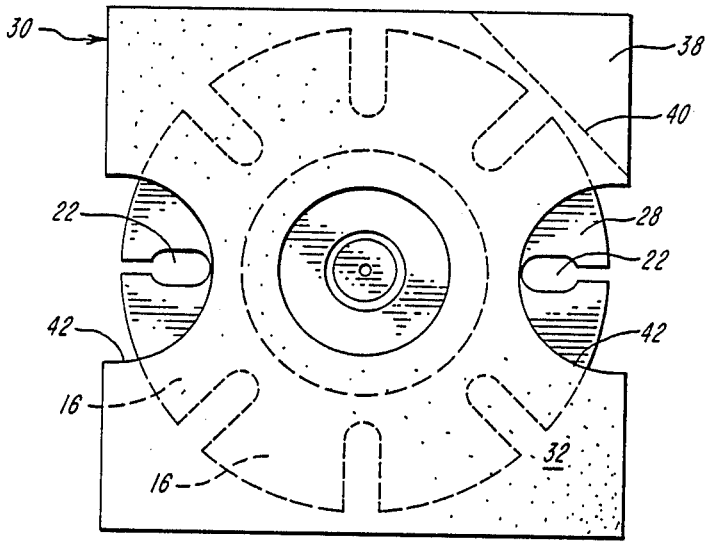

In FIGS. 5–7, an alternative embodiment of the invention is shown in which a block 10A is employed. The block 10A has a base structure 28 similar to the structure of block 10 of FIGS. 1–4, except that an adhesive coating is not applied. Instead, a pressure sensitive tape element 30 is applied to the base structure 28 either during initial manufacturing or subsequently.

As shown in FIG. 6, the pressure-sensitive tape 30 includes an adhesive sheet material 32, typically sold with upper and lower protective release liners 34, 36. One such pressure sensitive tape is a a styrene-butadiene block copolymer-based tape, such as the Scotch Brand Y-949 manufactured by 3M Company (Minneapolis, MN).

As also illustrated in FIG. 6, block 10A can be fabricated by removing lower release liner 36 of tape 30 and joining the exposed surface of adhesive sheet 32 to the compliant surface of base structure 28. The sheet 32 and base structure 28 can be joined by the action of the adhesive 32, itself, or, alternatively, a one-sided, pressure-sensitive sheet material can be used and affixed to the base structure by application of a heat sensitive glue or curing agent that induces a more permanent bond between the elements 28 and 32. In either case, the upper release liner 34 can be retained in place as a protective cover for the block until it is ready for use.

In FIG. 7, a front view block 10A is shown following application of the pressure-sensitive tape 30 and removal of the protective cover sheet to expose the adhesive sheet material 32. In this view, the underlying base structure 28 with its flexible lands 16 is shown largely in phantom.

Also shown in FIG. 7 is a gripping tab 38 on which a portion of the protective liner material has been retained (e.g., by scoring the adhesive tape 30 along score line 40) to provide a non-adherent surface to assist in the removal of the block from the finished optical element after shaping. FIG. 7 further illustrates a set of cutouts 42 in the pressure-sensitive tape 30 designed so that the center alignment hole 20 and the axis alignment markers 22 remain visible for alignment purposes.

The block 10A of FIGS. 5–7 is employed in the same manner as that described above in connection with block 10 or FIGS. 1–4. In both instances, the block is affixed to the optical element to be shaped, following alignment of the optical center with the center hole and optionally, alignment of a cylindrical axis with the axial alignment markers. Pressure is then applied to securely bond the block and optical element together.

After the shaping operations are completed, the block and finished lens are separated using either pneumatic or hydraulic pressure (via center hole 20, for example), or by pulling the gripping tab 38 of block 10A, or simply by exertion of firm manual tension to induce a peeling away of the block from the finished lens.

What we claim is:

1. A block for mounting an optical element onto a shaping machine, the block comprising:

a compliant receiving structure adapted to conform to a surface on an optical element to be shaped in a shaping machine, the compliant receiving structure having a plurality of flexible lands which are at least partially separated from each other by slots, such that the flexible lands of the receiving structure can bend to conform to the surface of the optical element;

an adhesive material disposed on at least a portion of the receiving structure; and a mounting means for mounting the block and an adhesively-joined optical element onto a shaping machine.

2. The block of claim 1 wherein the adhesive material is a pressure sensitive adhesive coating.

3. The block of claim 1 wherein the adhesive material is a pressure sensitive adhesive sheet affixed to the compliant receiving structure.

4. The block of claim 1 wherein the block further comprises center alignment means for aligning the block with a center point of the optical element.

5. The block of claim 4 wherein the center alignment means further includes a hole disposed in the center of the block to permit visual alignment of the block with the center point of the optical element.

6. The block of claim 1 wherein the block further includes axial alignment means for aligning the block with a cylindrical axis of the optical element.

7. The block of claim 6 wherein the block comprises a plurality of flexible lands separated by slots, and the alignment means includes a set of markers on two diametrically opposed slots to permit visual alignment of the block with the cylindrical axis of the optical element.

8. The block of claim 1 wherein the block further includes a non-adherent gripping means to assist in removal following shaping operations.

9. A block for mounting an optical element onto a shaping machine, the block comprising:

a compliant receiving structure adapted to conform to a surface on an optical element to be shaped in a shaping machine, the receiving structure comprising a plurality of flexible lands at least partially separated from each by slots, such that the flexible lands of the receiving structure can bend to conform to the surface of the optical element;

a pressure-sensitive adhesive material disposed on at least a portion of the receiving structure;

center alignment means for aligning the block with a center point of the optical element;

axial alignment mean for aligning the block with a cylindrical axis of the optical element; and a mounting means for mounting the block and an adhesively-joined optical element onto a shaping machine.

10. A method of mounting an optical element onto a shaping machine, the method comprising:

disposing a compliant block in close proximity to an optical element, the block comprising a compliant receiving structure adapted to conform to a surface on an optical element to be shaped in a shaping machine, an adhesive material on at least a portion of the receiving surface, an alignment means, and a mounting means for mounting the block onto a chuck of a shaping machine;

aligning said optical element with said block through the alignment means;

adhesively attaching the optical element to said compliant block in an aligned condition by applying the block to the optical element with sufficient pressure to bend the flexible lands and thereby conform the receiving structure to the surface of the optical element while said adhesive material joins the block and optical element together; and mounting the block and the adhesively joined optical element onto the shaping machine.

* * * * *